US005235249A

United States Patent [19]

Mourier

[11] Patent Number: 5,235,249

[45] Date of Patent: Aug. 10, 1993

[54] MULTIPLE-BEAM MICROWAVE TUBE WITH GROUPS OF ADJACENT CAVITIES

[75] Inventor: Georges Mourier, Mariel sur Mauldre, France

[73] Assignee: Thomson Tubes Electroniques, Boulogne Billancourt, France

[21] Appl. No.: 643,858

[22] Filed: Jan. 22, 1991

[30] Foreign Application Priority Data

Feb. 2, 1990 [FR] France ..... 90 01229

[51] Int. Cl.[5] ..... H01J 25/10

[52] U.S. Cl. ..... 315/5.14; 315/5.16; 315/5.39; 315/5.51; 315/5.38

[58] Field of Search ..... 315/5.14, 5.16, 5.39, 315/5.51, 39; 330/44, 45

[56] References Cited

U.S. PATENT DOCUMENTS 2,381,320 8/1945 Tawney ..... 315/5.16
3,248,594 4/1966 Boyd ..... 315/5.39 X
3,305,749 2/1967 Hogg ..... 315/3.6
4,733,131 3/1988 Tran et al. ..... 315/4 X

FOREIGN PATENT DOCUMENTS 248689 5/1987 European Pat. Off. .
1346853 11/1963 France .
1423769 11/1965 France .
6401815 8/1964 Netherlands .
662567 12/1951 United Kingdom .

OTHER PUBLICATIONS

Proceedings of the Institutions of Electrical Engineers; vol. 109 B; E. F. Belohoubek; May 1962; pp. 718–722.
Electronics vol. 35 No. 13 New York US.

*Primary Examiner*—Robert J. Pascal
*Assistant Examiner*—Benny T. Lee
*Attorney, Agent, or Firm*—Roland Plottel

[57] ABSTRACT

Disclosed is a microwave tube with n (where n is an integer greater than one) parallel, longitudinal electron beams distributed on a ring centered on an axis XX'. The electron beams go through several groups of n cavities. So that each group may resonate on a single frequency, it is provided that the cavities of one and the same group will work in their dominant mode, at one and the same frequency, and will get excited in phase. To this end, the cavities of the input group are excited in phase by an appropriate device external to the tube. The device can be applied to multiple-beam klystrons working at high frequencies.

14 Claims, 4 Drawing Sheets

Section AA'

Section BB'

MULTIPLE-BEAM MICROWAVE TUBE WITH GROUPS OF ADJACENT CAVITIES

BACKGROUND OF THE INVENTION

1. Field of the Invention

The present invention concerns multiple-beam microwave tubes with longitudinal interaction, such as multiple-beam klystrons.

2. Description of the Prior Art

A multiple-beam klystron has N parallel longitudinal electron beams produced by one or more electron guns. The splitting up of a beam into several elementary beams has the advantage of reducing the space-charge effects and of giving a tube with greater efficiency. This also enables the current and power of the tube to be increased or else its operating voltage to be reduced.

Several standard single-beam klystrons can be grouped together in one and the same envelope: in this way a multiple-beam klystron is obtained. The single-beam klystrons are distributed on a ring centered on an axis. This axis is the axis of the multiple-beam klystron. The different electron beams are then parallel to this axis. This construction enables certain elements of standard single-beam klystrons to be used without any notable modification. The beams produced by each of the klystrons are then elementary beams. They go through successive cavities, each cavity being crossed b all the beams.

A standard single-beam klystron is built around an axis which is the axis of the electron beam. A microwave to be amplified is introduced into the order 1 cavity which is on the gun side. This is the input cavity. The last cavity or order m cavity is connected to an external operating element by means of a short transmission line. This is the output cavity. The transmission line is generally positioned crosswise with respect to the axis of the tube. It receives the microwave after amplification. The electron beam is collected in a collector that is coaxial with the axis of the tube. This collector is placed downline of the order m cavity. A focusing device surrounds the cavities. It prevents any divergence of the electron beam.

In a multiple-beam klystron formed by several single-beam klystrons grouped together in one and the same envelope, the focusing device may be common to all the tubes.

In French patent application No. 89 07784, filed on 13th Jun. 1989, the present Applicant has already proposed a klystron type microwave tube having an output coaxial with the collector. According to one embodiment, this application describes a multiple-beam klystron built around an axis. This klystron has, chiefly, a gun producing several electron beams, successive cavities and a collector. Each cavity is crossed by all the beams. The collector located downline of the last cavity is coaxial with the axis of the tube. The last cavity is coupled to a transmission line that surrounds the collector and is coaxial with it. This transmission line is, for example, a coaxial waveguide. The coupling between the output cavity and the transmission line is achieved by at least one coupling aperture.

At low frequency, this tube works appropriately, but once the frequency rises the cavities may contain a large number of modes, for they are oversized in relation to the wavelength transmitted in space.

To overcome this drawback, the dimensions of the cavities must decrease once the frequency is increased.

However, these dimensions cannot be reduced sufficiently because of the space taken up by the gun or guns producing the electron beams.

The present invention seeks to overcome this drawback and proposes a multiple-beam microwave tube having groups of cavities. Each group of cavities resonates on only one frequency. Furthermore, this tube can work at high frequency.

SUMMARY OF THE INVENTION

The present invention proposes a microwave tube comprising:

n (where n is an integer greater than one) parallel, longitudinal electron beams distributed on a ring centered on an axis XX'. The beams go through several groups of n cavities. The cavities of one and the same frequency, and are excited in phase so that each group resonates on only one frequency.

According to one variant, a cavity is achieved by the coupling of several elementary cavities, only one of the elementary cavities being crossed by an electron beam.

The tube includes a group of input cavities, the cavities of this group being excited in phase by an appropriate device external to the tube.

According to a first construction, the cavities of the input group are coupled to one another, the excitation device being formed by a transmission line coupled to one of the cavities.

According to another construction, the cavities of the input group are electrically insulated from one another. They are excited in phase by a transmission line that gets divided into n identical sections, each section being coupled to one of the cavities. The transmission line may also be coupled to an additional cavity. All the cavities of the input group are symmetrically coupled to the additional cavity.

The tube includes a group of output cavities.

There are also several variants for outputting the microwave energy output.

According to a first construction of this output, the cavities of the output group are electrically insulated from one another. They are coupled by at least one aperture to a transmission line that is coaxial with the axis of the tube.

According to another construction, the cavities of the output group are coupled to one another. One of the cavities is coupled to a lateral transmission line.

The invention shall be explained in detail by means of the following description. This description shall be made with reference to the appended drawings.

DETAILED DESCRIPTION OF THE INVENTION

Figure 2:
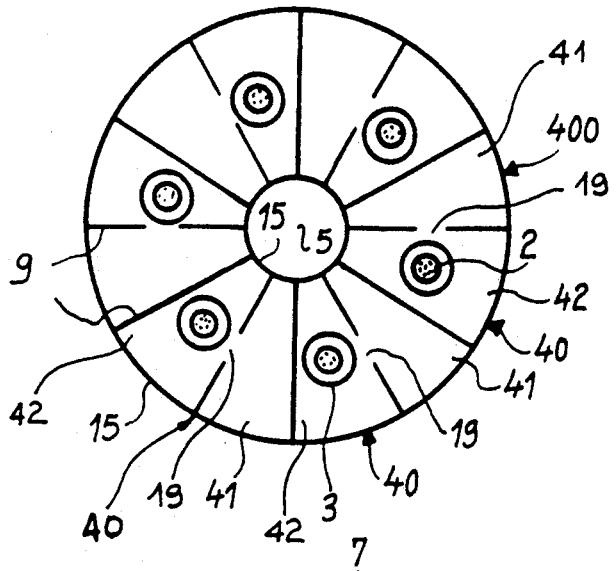
FIG. 2 shows a cross-section, along the axis AA' of FIG. 1, of the group of output cavities.
Figure 1:
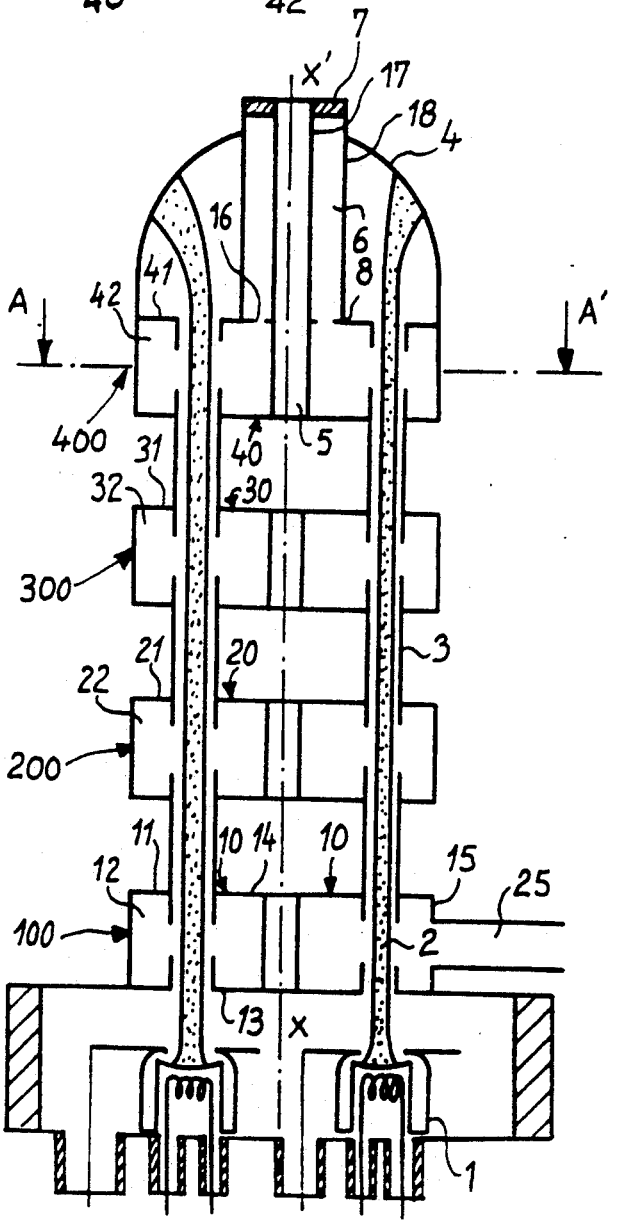
FIG. 1 shows a partial schematic view, in longitudinal section, of a multiple-beam klystron with coaxial output, according to the invention.

The multiple-beam klystron shown in FIGS. 1 and 2 is a klystron with n electron beams 2 where n is an integer greater than one. Here n is equal to six. Each of these electron beams is produced by an electron gun 1. The electron beams 2 are longitudinal and parallel. The klystron as shown in FIG. 1 is built around an axis of revolution XX'. The six electron guns 1 are distributed on a ring centered on the axis XX'. Each electron beam 2 goes through cavities 10, 20, 30, 40, positioned one after the another. Two successive cavities are separated by a drift tube 3.

Each cavity 10 placed in the vicinity of each electron gun is a cavity of the order 1, and the following cavities are respectively of the orders 2, 3,...m (where m is an integer greater than 1). In FIG. 1, m is equal to 4. The cavities 10 are known as input cavities. The cavities 40 are known as output cavities.

It is possible to define groups 100, 200, 300, 400 of cavities. These groups of cavities comprise cavities of the same order crossed by different electron beams 2. The group 100 is the input group. The group 400 is the output group.

The cavities 10, 20, 30, 40 belonging to one and the same group are identical. They may work at their dominant mode at a same frequency. It can be envisaged that this frequency is slightly different from one group to another.

A microwave to be amplified is introduced into the input group 100. This wave excites the cavities of the input group 100 and then, step by step, it excites the cavities of the other groups 200, 300, 400. The output group 400 is connected to a device designed to collect the microwave after amplification. This device is formed by a transmission line 6 which, for example, may be a circular waveguide or a coaxial guide.

A coaxial guide includes an internal conductor surrounded by an external conductor. The external conductor is hollow. The internal conductor may be solid or hollow. These two conductors are preferably coaxially mounted cylinders of a shape generated by revolution. The space between the two conductors may be filled with air or with a gas, or it may be under vacuum.

A cavity 10, 20, 30, 40 may be formed by several elementary cavities 11, 12, 21, 22, 31, 32, coupled to one another. Only one of the elementary cavities is crossed by an electron beam.

FIG. 2 shows the group of output cavities 400. The FIGURE is not drawn to scale.

This group of output cavities 400 includes six cavities 40 electrically insulated from one another. Each cavity 40 is formed by two elementary cavities 41, 42 coupled to one another. Only the elementary cavity 42 is crossed by an electron beam. The two elementary cavities 41, 42 are coupled by a coupling aperture 19.

We shall now return to FIG. 1. The output group 400 is coupled to the transmission line 6. All the cavities 40 are, for example, coupled by at least one coupling aperture 16 to the transmission line 6. The direct couplings between cavities 40 are practically zero. However, there are indirect coupling because electromagnetic fields are overflowing through the coupling apertures 16. These couplings are weak as compared with couplings with the transmission line 6, but are not negligible.

Figure 5:
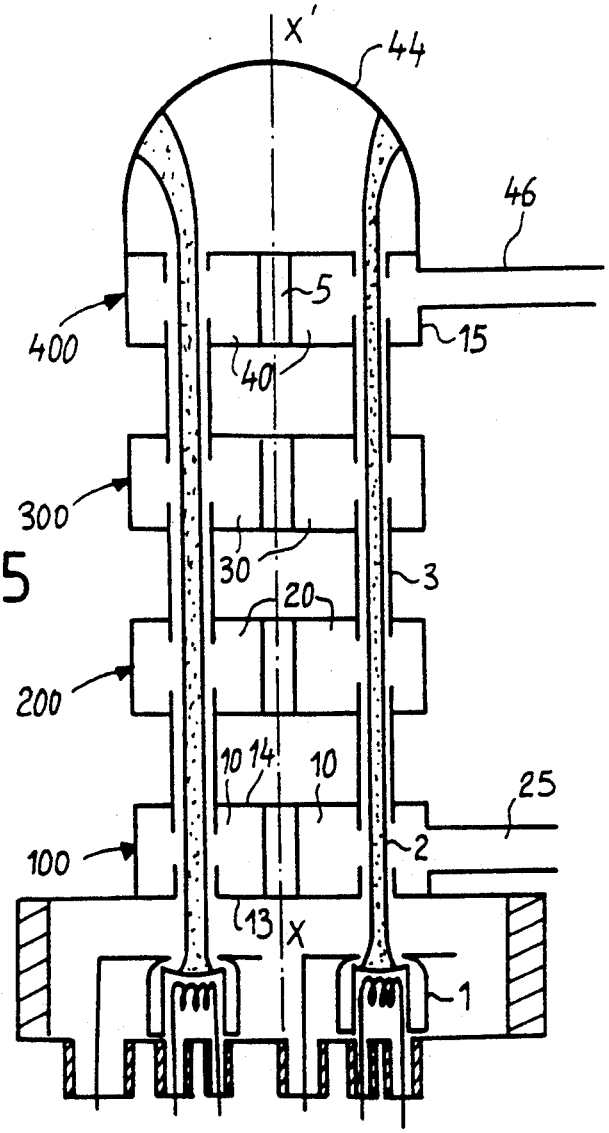
FIG. 5 shows a longitudinal section of a multiple-beam klystron with a lateral output according to the invention.

In another configuration shown in FIG. 5, the cavities 40 are all coupled to one another. The transmission line may then be coupled to only one of the cavities 40, at the level of an elementary cavity 41 or 42.

According to the present invention, it is provided that the group of output cavities 400 will resonate on a single frequency. For, when several identical cavities, resonating at one and the same frequency, are coupled, the group of cavities has as many resonance frequencies as it has cavities. These resonance frequencies are staggered and their differences correspond to phase-shifts between neighboring cavities.

A simple way of making the groups of output cavities 400 resonate on a single frequency is to have the output cavities 40 all excited in phase. The phase-shift between neighboring cavities is substantially zero. The group of output cavities 40 then resonates in the so-called "zero" mode.

The excitation in phase of the output cavities 40 depends on the excitation of the input cavities 10.

The invention provides for an excitation in phase of the cavities 10 belonging to the input group 100.

The excitation in phase gets transmitted step by step to the cavities of the other groups. The cavities of one and the same group are then excited in phase. Each group of cavities resonates on a single frequency.

Before looking at the different possibilities for exciting the cavities 10 in phase, we shall give a more detailed description of the cavities, the output and the collector of the klystrons according to the invention.

As can be seen in FIGS. 1 and 2, a group 100, 200, 300, 400 of cavities has a shape of a ring centered on the axis XX'. A dead space 5 can be defined in the central hollowed-out part of the ring. This dead space is partially unused.

The cavities 40 are all identical and have the shape of a ring sector. In FIG. 2, the cavities 40 are formed by two identical, elementary cavities 41, 42 having the shape of a ring sector.

Each of the elementary cavities 11, 12, 21, 22, 31, 32... is demarcated by six walls. This is also the case for the cavities 10, 20, 30, 40.

Two first walls 9 (see FIG. 2) are radial, and two other walls 13, 14 (See FIG. 1) are transversal to the axis XX' and face each other. An electron beam 2 penetrates an elementary cavity on the wall 13 side and comes out of this cavity on the wall 14 side. The wall 14 is a terminal wall. The other two walls 15, shaped like a cylinder sector, close the ring sector. These are lateral walls: one of them, the internal wall, faces the dead space 5 while the other, which is the external wall, faces the exterior of the tube.

The elementary cavities 11, 12, 21, 22... could have had a different shape: they could have been shaped like a cylinder or like a cylinder sector, for example. This is also the case for the cavities 10, 20, 30, 40.

According to a first construction, shown in FIG. 1, the transmission line 6 extends along the prolongation of the axis XX'. This transmission line 6 is connected by one side to the klystron and by the other side to an energy-using apparatus which is not shown. The transmission line 6 is a coaxial guide. It has an internal conductor 17 and an external conductor 18. Its axis is the same as the axis XX'. The coaxial guide 6 has one end 7 connected to the energy-using apparatus. This is its upper end. Its other end 8 is fixedly joined to the klystron. This is its lower end or its base. The base 8 of the coaxial guide is fixedly joined to the terminal wall 14 of the elementary output cavities 41, 42. The connection between the coaxial guide 6 and the elementary output cavities 41, 42 should be impervious to prevent outward leaks of microwave energy.

Each output cavity 40 shown in FIG. 1 has a coupling aperture 16 which goes through its terminal wall 14 and opens into the interior of the transmission line 6. It is located on an elementary cavity 41 or on an elementary cavity 42.

The coupling apertures 16 of the output cavities 40 are distributed on a ring centered on the axis XX'. If the transmission line is a coaxial guide, the coupling apertures 16 will open out into the space between the internal conductor 17 and the external conductor 18.

Each beam 2 crosses an elementary cavity 42 from one side to the other, and is collected in a collector 4 which is the sole collector for the tube. This collector 4 surrounds the transmission line 6 and is concentric with it. The collector 4 has the general shape of a hollow cylinder. It is metallic. It is fixedly joined at its base with the terminal wall 14 of the output cavities 40. Its upper end is closed, and it may rest on the transmission line 6. In FIG. 1, the collector 4 has the shape of a dome. The electron beams 2 penetrate the interior of the collector 4 and strike its external wall. The surface area of this external wall will be sufficient to enable effective cooling. Since the collector is placed outside the transmission line 6, its maximum dimensions are not limited.

A circuit enabling the flow of a cooling fluid may be placed inside the collector 4, around the transmission line 6 for example. This construction will be used above all if the klystron works at a high level of mean and/or peak power.

Dimensional constraints appear only for the transmission line 6. The external diameter of the transmission line 6 should be smaller than the internal diameter of the ring on which the electron beams are positioned. Furthermore, it is useful to restrict the external diameter of the transmission line 6 so that there is no unnecessary addition of any higher mode. When the transmission line 6 is a coaxial guide, its internal conductor 17 could extend the dead space 5 located at the center of the groups of cavities.

Preferably, an impervious microwave window 19 will be placed inside the transmission line 6, before the connection with the energy-using apparatus. This window 19 is designed to maintain a high vacuum within the tube while, at the same time, letting the microwaves pass through towards the energy-using apparatus. Instead of using only one window 19, it could also be possible to block all the coupling apertures 16 with windows.

If the transmission line 6 is a circular waveguide, this waveguide will preferably work in $TM_{01}$ mode. This $TM_{01}$ mode is easily coupled with the mode of the cavities because of its axial symmetry.

If the transmission line 6 is a coaxial guide, this coaxial guide will preferably work in TEM mode which is the most commonly used mode.

Figure 3:
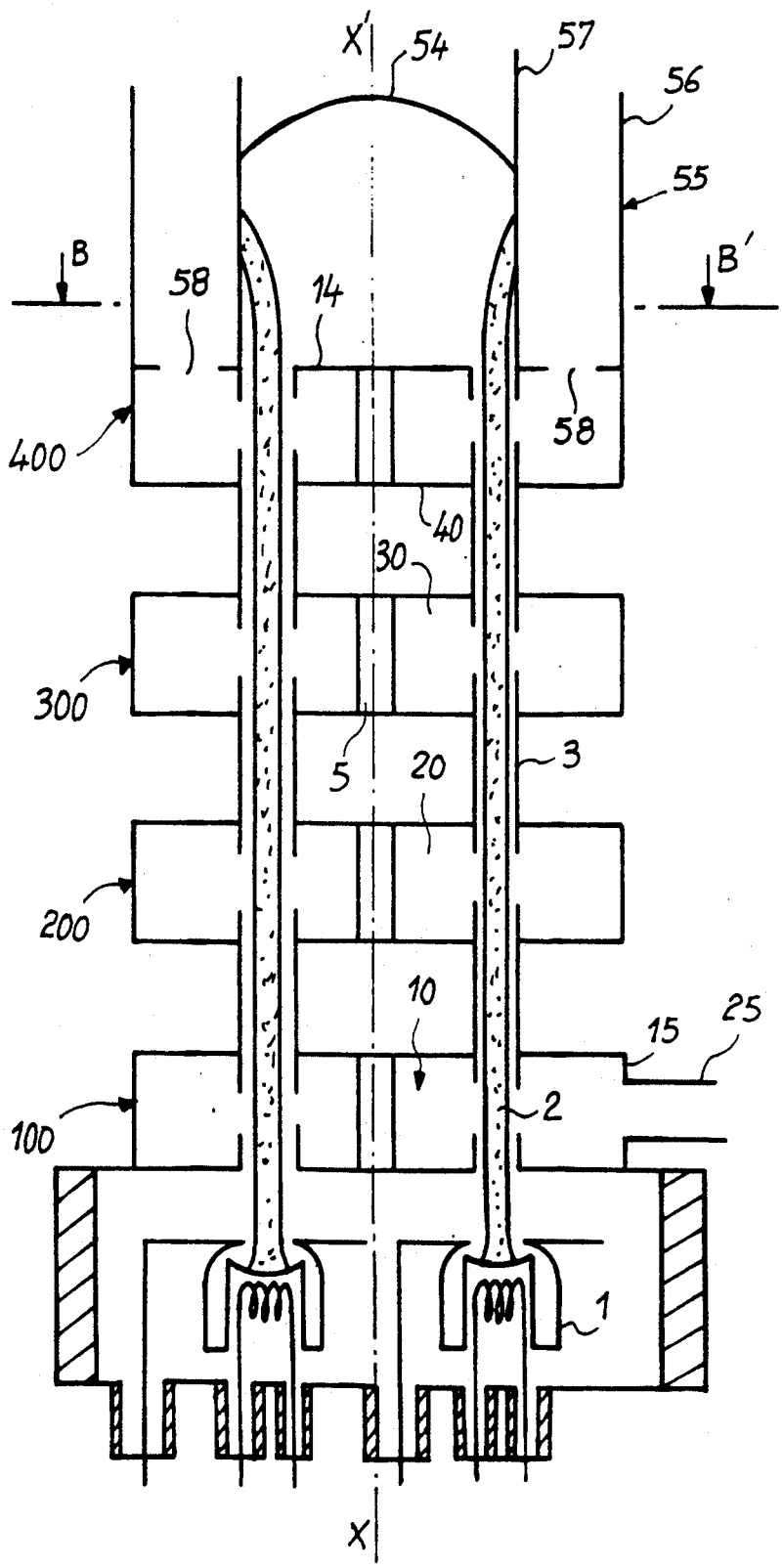
FIG. 3 shows a longitudinal section of a variant of the output and of the collector of a klystron according to the invention.
Figure 4:
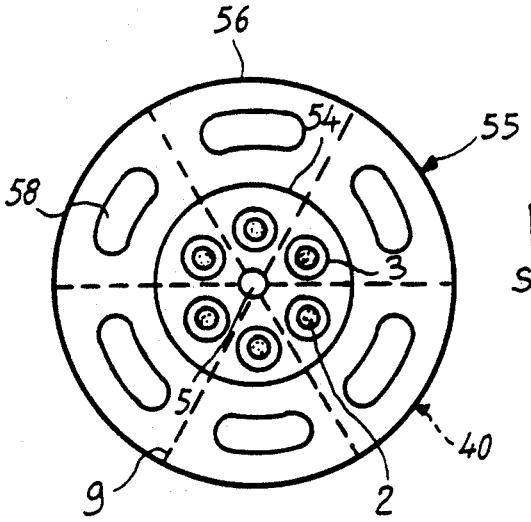
FIG. 4 shows a cross-section, along the axis BB' of FIG. 3, of the collector of the klystron.

FIGS. 3 and 4 show a first variant of the output and of the collector of a klystron according to the invention. Each output cavity 40 comprises only one cavity. The cavities 40 are electrically insulated from one another. The collector bears the reference 54. It is located in the prolongation of the axis XX' and is coaxial with it. It is central. It has the shape of a hollow cylinder. The transmission line bears the reference 55. It is coaxial with the collector 54 and surrounds it. The transmission line 55 is a coaxial guide. Its external conductor rests on the external wall of the cavities 40. Its internal conductor 57 rests on the top of the collector 54. It has substantially the same diameter.

Each output cavity 40 has a coupling aperture 58 through its terminal wall. In FIG. 4, this coupling aperture 58 is oblong and opens out into the interior of the transmission line 55, in the space between the internal conductor 57 and the external conductor 56.

As in the construction described in FIG. 1, it is possible to place an impervious window within the transmission line 55 or else several impervious windows to block the coupling apertures 58. These windows are not shown.

FIG. 5 shows another variant of the output and of the collector of a klystron according to the invention. The transmission line 46 is now lateral. It is shown in the FIGURE, transversal to the axis XX'. The cavities 40 are all coupled to one another. The transmission line 46 is coupled to a single cavity 40.

The coupling is achieved by means of at least one aperture through the external lateral wall 15 of the cavity 40. It is seen to it that the coupling is more intense between two adjacent cavities 40 than between the transmission line 46 and the cavity 40 to which it is coupled.

In a standard way, the collector 44 is placed in the prolongation of the axis XX' and is concentric with it.

Through the coupling aperture 16, 58, each output cavity 40 excites electromagnetic fields in the transmission line 6, 55 when the klystron has the configuration of FIG. 1 or FIG. 3.

When the klystron has the configuration of FIG. 5, the cavity 40 connected to the transmission line 46 excites electromagnetic fields within this transmission line 46.

We have seen that the excitation of the output cavities 40 depends on the excitation of the input cavities 10.

The input cavities 10 must also be excited in phase. To obtain high efficiency, the amplitudes of the fields excited in the input cavities 10 should be substantially equal. There are several embodiments that enable the input cavities 10 to be excited in phase.

In FIG. 1, the input cavities 10 are coupled to one another by apertures or by loops. Only one of the input cavities is excited at the frequency F, by being connected to a transmission line 25. This is the right-hand cavity. This transmission line is a waveguide that propagates a microwave to be amplified coming from a microwave source (not shown). The cavities 10 are then all excited in phase if the frequency F is chosen properly. Furthermore, it is preferable for the amplitudes of the fields excited in the cavities 10 to be substantially equal. To this end, the coupling between neighboring cavities 10 should be more intense than the coupling between the transmission line 25 and the elementary cavity 10 to which it is coupled.

According to one variant, the input cavities 10 are electrically insulated from one another. They are each separately excited in phase by a transmission line, with all the lines being connected to one and the same microwave source. This variant makes it possible to obtain greater electrical symmetry than was previously the case, at the cost of mechanical complications.

Figure 6:
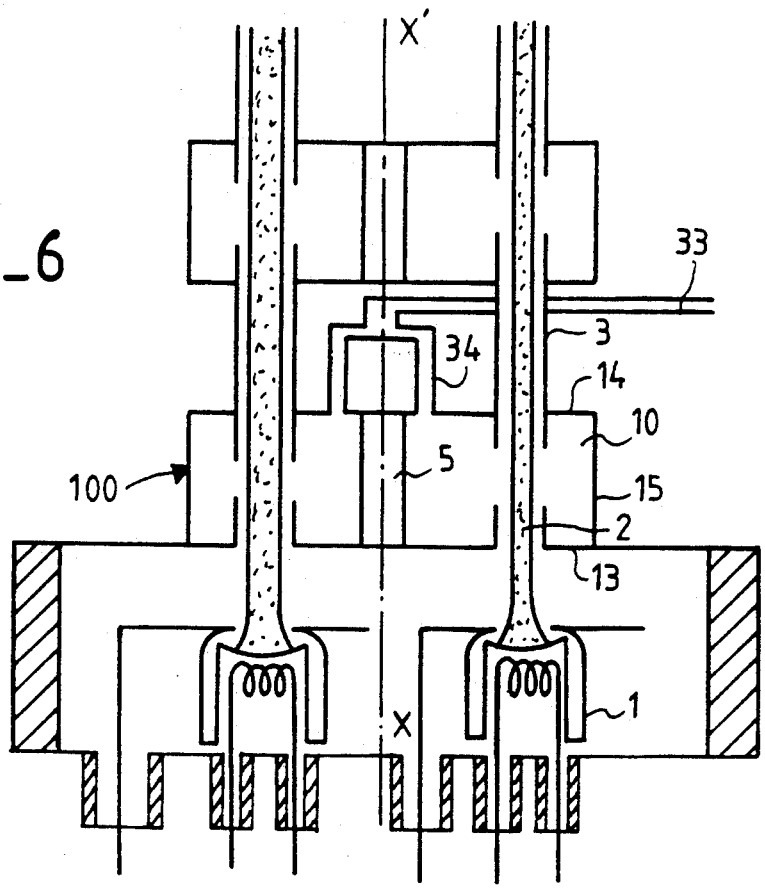
FIG. 6 shows a longitudinal section of a device for the excitation of the group of input cavities of a klystron according to the invention.

FIG. 6 shows a first embodiment of this variant. A transmission line 33 with a small cross-section is used. This transmission line 33 penetrates the interior of the klystron in a direction that is substantially transversal to the axis XX', between two contiguous drift tubes 3. The transmission line 33 gets divided, at one end, into small sections 34 each coupled to a cavity 10.

The other end of the transmission line 33 is connected to a microwave source (not shown). The coupling is done at the terminal walls 14 of the input cavities 10. The coupling is done by apertures or by loops. The small sections 34 will preferably be placed symmetrically with respect to the axis XX'. They could be distributed on a ring centered on the axis XX'. The transmission line 33 and the sections 34 will preferably be either waveguides or coaxial guides.

Figure 7:
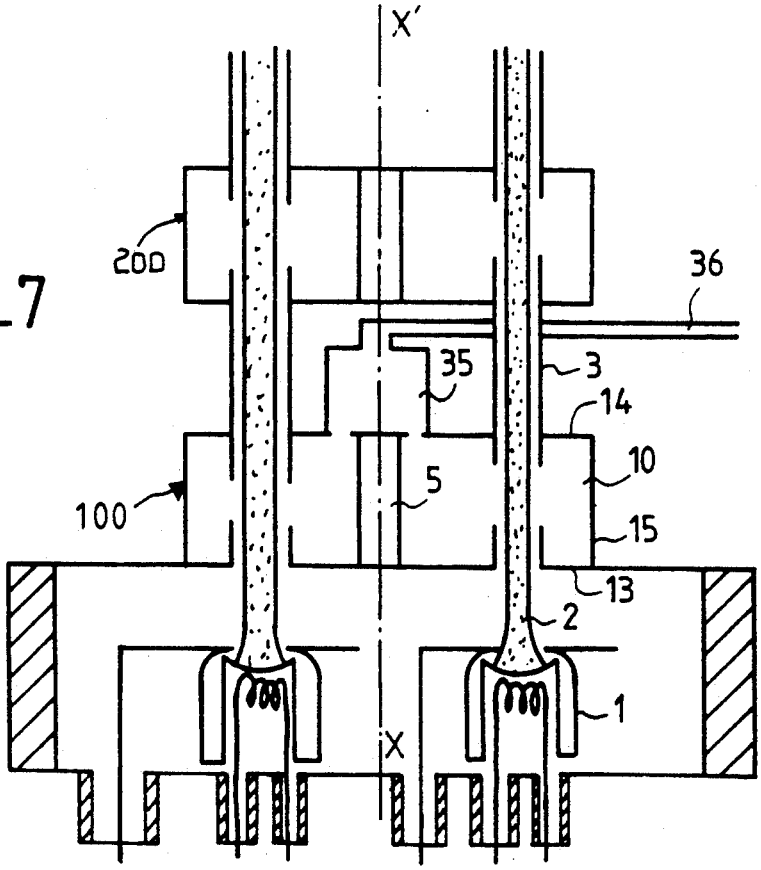
FIG. 7 shows a longitudinal section of a variant of a structure for the excitation of the group of input cavities of a klystron according to the invention.

FIG. 7 shows a second embodiment of this variant. In this construction, all the cavities 10 have been coupled to an additional cavity 35. The additional cavity 35 is positioned in a space demarcated by the drift tubes 3 between the group of cavities 100 and the group of cavities 200. This additional cavity 35 will be, for example, cylindrical and coaxial with the axis XX'. The additional cavity 35 is coupled, on one side, to all the input cavities 10 symmetrically, and on the other side to a transmission line 36 with a small diameter This transmission line 36 will be positioned, for example, like the transmission line 33 described in FIG. 6. The loops or apertures enabling the additional cavity 35 and the input cavities 10 to be coupled will go through the terminal walls 14 of the cavities 10. These coupling apertures or these loops will preferably be distributed on a ring centered on the axis XX'.

In the other groups of cavities 200, 300, the cavities 20, 30 will preferably be electrically insulated electrically from one another, but they could also be coupled to one another.

The present invention is not restricted to the examples described. Variants are possible, notably with respect to the number of cavities, the number of elementary cavities and their shapes, the number of groups, the coupling devices between adjacent cavities, the coupling devices between adjacent elementary cavities, and the coupling devices between the cavities and the transmission lines.

What is claimed is:

1. A microwave tube disposed around an axis XX' comprising: n, where n=an integer number greater than 1, means for providing n electron beams parallel to the axis and surrounding said axis, a succession of groups of cavities aligned along the axis XX', said succession including an input group, each group comprising n adjacent cavities resonating at a same frequency, each beam respectively aligned to pass through a corresponding cavity in each group, and external means coupled at least to a cavity of the input group, means for providing phase excitation signal into each cavity of the input group, and said phase excitation signal interacts with the n electron beams such that the n electron beams are the sole means for coupling the interacting phase excitation signal to successive groups and each group resonates at a single frequency.

2. A microwave tube according to claim 1, wherein the succession of groups includes an output group of adjacent cavities.

3. A microwave tube according to claim 2, further comprising a transmission line coaxial with the axis and coupled to the cavities of the output group, wherein the n electron beams, after they have crossed the cavities of the output group, penetrate into a single collector which surrounds the transmission line and is coaxial with the transmission line.

4. A microwave tube according to claim 2, further comprising means for providing direct coupling between the adjacent cavities of the output group.

5. A microwave tube according to claim 4 wherein one of the cavities of the output group is coupled to a lateral transmission line.

6. A microwave tube according to claim 5, wherein the direct coupling between two adjacent cavities of the output group has an intensity which is more than an intensity associated with coupling between the transmission line and the cavity to which it is coupled.

7. A microwave tube according to claim 2, wherein the adjacent cavities of the output group are free from mutually direct coupling.

8. A microwave tube according to claim 1, wherein the cavities of each group are divided into adjacent elementary cavities, said elementary cavities being directly mutually coupled.

9. A microwave tube according to claim 1, wherein the adjacent cavities of the input group are free from mutually direct coupling.

10. A microwave tube according to claim 9, wherein the external means comprises a transmission line for propagating microwave energy, the transmission line having an extremity divided into n identical sections, each section being coupled to a respective cavity of the input group.

11. A microwave tube according to claim 9, wherein the external means comprises a transmission line for propagating microwave energy, and an additional cavity, said additional cavity having one side which is coupled to the transmission line and having another side which is coupled to each cavity of the input group.

12. A microwave tube according to claim 1, wherein there is mutually direct coupling means disposed between the adjacent cavities of the input group.

13. A microwave tube according to claim 12, wherein the external means comprises a transmission line for propagating microwave energy, and a coupling between an extremity of the transmission line and one of the cavities of the input group.

14. A microwave tube according to claim 13, wherein the direct coupling between two adjacent cavities of the input group has an intensity which is more intense than an intensity associated with the coupling between the transmission line and the cavity to which it is coupled.

* * * * *